US008256242B1

(12) United States Patent
Evans

(10) Patent No.: US 8,256,242 B1
(45) Date of Patent: Sep. 4, 2012

(54) COOLER WITH MULTIPLE COMPARTMENTS

(76) Inventor: Deborah B. Evans, Sylvania, GA (US)

( * ) Notice: Subject to any disclaimer, the term of this patent is extended or adjusted under 35 U.S.C. 154(b) by 550 days.

(21) Appl. No.: 12/460,513

(22) Filed: Jul. 21, 2009

Related U.S. Application Data

(60) Provisional application No. 61/135,406, filed on Jul. 21, 2008.

(51) Int. Cl.
*F25D 3/08* (2006.01)

(52) U.S. Cl. ..... 62/457.7; 62/457.9

(58) Field of Classification Search ..... 62/457.7, 62/457.1, 457.5, 457.9, 371; 220/592.2, 220/915.2
See application file for complete search history.

(56) References Cited

U.S. PATENT DOCUMENTS

| | | | | | |
|---|---|---|---|---|---|
| 3,591,194 | A | | 7/1971 | Vega | |
| 4,286,440 | A | | 9/1981 | Taylor | |
| 4,671,079 | A | | 6/1987 | Petrantoni | |
| 4,873,841 | A | * | 10/1989 | Bradshaw et al. | 62/239 |
| 5,249,438 | A | * | 10/1993 | Rhaney et al. | 62/457.7 |
| 5,295,369 | A | | 3/1994 | Garcia | |
| 5,509,279 | A | | 4/1996 | Brown et al. | |
| 5,570,588 | A | * | 11/1996 | Lowe | 62/457.7 |
| 6,058,733 | A | | 5/2000 | Morgan | |
| 6,305,185 | B1 | * | 10/2001 | Sloan | 62/457.7 |
| 6,318,114 | B1 | * | 11/2001 | Slaughter | 62/457.2 |
| 6,318,740 | B1 | | 11/2001 | Nappo | |
| 6,364,329 | B1 | * | 4/2002 | Holub et al. | 280/47.26 |
| 6,467,779 | B1 | * | 10/2002 | Mills | 280/47.26 |
| 6,474,097 | B2 | * | 11/2002 | Treppedi et al. | 62/457.7 |
| 6,763,678 | B2 | * | 7/2004 | Harper | 62/461 |
| 6,895,778 | B1 | | 5/2005 | Ackerman | |
| 7,188,491 | B2 | * | 3/2007 | Donald et al. | 62/457.7 |
| 7,389,608 | B1 | * | 6/2008 | MacKay | 43/57 |
| 7,451,709 | B2 | * | 11/2008 | Swartfager et al. | 108/14 |
| 2002/0088244 | A1 | * | 7/2002 | Jennings et al. | 62/371 |

* cited by examiner

*Primary Examiner* — Mohammad Ali
(74) *Attorney, Agent, or Firm* — Montgomery Patent & Design, LLC; Robert C. Montgomery; Joseph Yaksich

(57) ABSTRACT

An insulated cooler with two (2) separate independent storage compartments and lids allowing for compartmentalized transportation and storage of items is herein disclosed. The separate compartments eliminate possible cross-contamination as well as provide different thermal conditioning of the contents. The compartments are completely independent of each other having an interior divider wall extending completely through the body of the cooler and continuing into a lid area, thereby sealing independent compartments. Additionally, each compartment is also provided with a draining means.

16 Claims, 6 Drawing Sheets

COOLER WITH MULTIPLE COMPARTMENTS

RELATED APPLICATIONS

The present invention was first described in and claims the benefit of U.S. Provisional Application No. 61/135,406 filed Jul. 21, 2008, the entire disclosures of which are incorporated herein by reference.

FIELD OF THE INVENTION

The present invention relates generally to mobile coolers, and more particularly, to a mobile cooler with multiple independent storage compartments.

BACKGROUND OF THE INVENTION

A mobile cooler or portable ice chest is most commonly an enclosed insulated structure used to keep food and drink stuffs cool for periods of time away from a main refrigerated area. Typically ice cubes or some other frozen medium are placed inside the insulated structure to provide the cooling means. They are usually made from interior and exterior plastic shells with insulating foam in between and come in various sizes. Portable coolers are a useful piece of equipment for many outdoor activities. One (1) problem with traditional coolers having a single storage compartment is cross contamination during certain activities which requires different coolers each dedicated to a different task. One (1) such activity is fishing, in which there is normally a cooler for food, a cooler for drinks, a cooler for bait, and perhaps a cooler for holding caught fish. The use of multiple coolers is often necessity to prevent cross contamination between food and other items. This means that multiple coolers must be packed, transported, and carried to the activity site whether they are completely filled or not. Other disadvantages to traditional coolers are that some items may need to be maintained at different cooled temperatures to prevent spoilage, some items may need to remain dry, and levels of desired freshness are not always the same.

Various attempts have been made to provide improved portable cooler devices, which can be seen by reference to several U.S. patents. U.S. Pat. No. 3,591,194, issued in the name of Vega, describes an ice chest cart that allows access to different storage compartments. U.S. Pat. No. 4,286,440, issued in the name of Taylor, describes a compartment cooler having a central compartment for food and multiple outer compartments for beverage bottles. U.S. Pat. No. 6,474,097, issued in the name of Treppedi et al., describes a compartmented mobile cooler having an ice cooler portion and a thermos container portion.

While these devices fulfill their respective, particular objectives, each of the prior examples suffers from one (1) or more of the aforementioned disadvantages. Accordingly, there exists a need for a means by which a single cooler system can serve the needs of independent items. The development of the present invention substantially departs from the conventional solutions and in doing so fulfills this need.

SUMMARY OF THE INVENTION

In view of the foregoing references, the inventor recognized the aforementioned inherent problems and observed that there is a need for a cooler with multiple compartments that provides a means to store and transport various items that should be kept cold that prevents cross contamination and the need to carry multiple coolers. The object of the present invention is to solve the aforementioned disadvantages and provide for this need.

To achieve the above objectives, it is an object of the present invention to provide a cooler with multiple compartments comprising at least two (2) separate and thermally independent storage compartments having insulated wall and floor portions that provide compartmentalized transportation and storage of items. A cooler body is divided by at least one (1) interior divider wall which extends between wall portions of the body to form the independent storage compartments. Each compartment has an independent lid portion with a hand grip that provides effective sealing for the independent compartments and a separate drain spigot. At least two (2) wheels are provided that enable efficient transportation of the cooler.

Another object of the present invention is to provide a cooler comprising at least two (2) smaller independent compartments that are completely isolated from one another and provides a means of keeping food stuffs and other items cool. The compartments enable users to keep personal items separate and the compartmentalized lid portions enable access to desired compartments providing a means of keeping items in other compartments cooler for longer periods of time.

Yet still another object of the present invention is to provide a cooler comprising at least two (2) independent compartments having separate drainage means. The drain provides a means to remove water or waste from separate and particular compartments without cross contamination.

Yet still another object of the present invention is to provide a cooler comprising at least two (2) wheels that are positioned slightly above the ground surface when the apparatus is at a resting stationary state. Once a handled end portion of the cooler body is lifted the wheels pivot downwardly making contact with the ground surface.

Yet still another object of the present invention is to provide a cooler comprising a pivoting handle with an ergonomic grip that provides a means to engage and pull the apparatus utilizing the wheels and at least two (2) pivoting handles that provide a means to manually lift or carry the apparatus.

Yet still another object of the present invention is to provide a method of utilizing the cooler that provides a means for transporting multiple types of beverages, food and other items to be kept cold in one common cooler in a manner which is quick, easy and effective.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
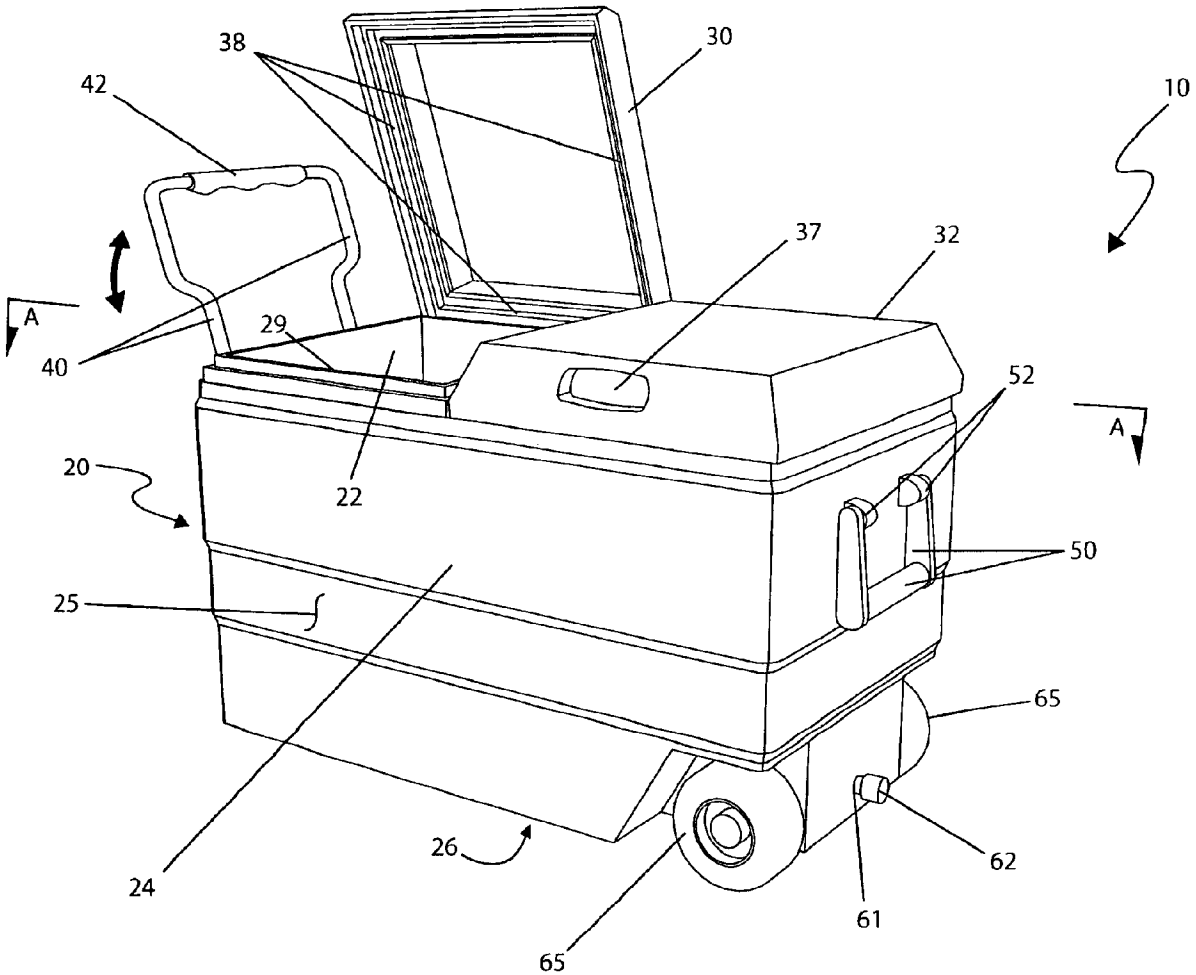
FIG. 1 is a right-hand perspective view of a cooler with multiple compartments 10, according to a preferred embodiment of the present invention.

10 cooler with multiple compartments
20 cooler body
22 forward compartment
23 rear compartment
24 body dividing wall
25 body outer wall
26 body floor
29 first sealing surface
30 forward lid
32 rear lid
34 lid hinge
37 lid hand grip
38 second sealing surface
40 first handle
42 first handle grip
44 first handle pivot
46 first handle clip fixture
50 second handle
52 second handle pivot
60 drain
62 drain cap
65 wheel
67 axle member

DETAILED DESCRIPTION OF THE PREFERRED EMBODIMENT

The best mode for carrying out the invention is presented in terms of its preferred embodiment, herein depicted within FIGS. 1 through 4*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a cooler with multiple compartments (herein described as the "apparatus") 10, comprising two (2) separate and thermally independent storage compartments allowing for compartmentalized transportation and storage of items such as food, bait, caught fish, drinks, and other items. An interior divider wall 27 extending completely between side portions of a cooler body 20 is continued into independent lid portions as well, thus providing effective sealing of the independent compartments. Additionally, each compartment is provided with a separate drain spigot 50.

Figure 2A:
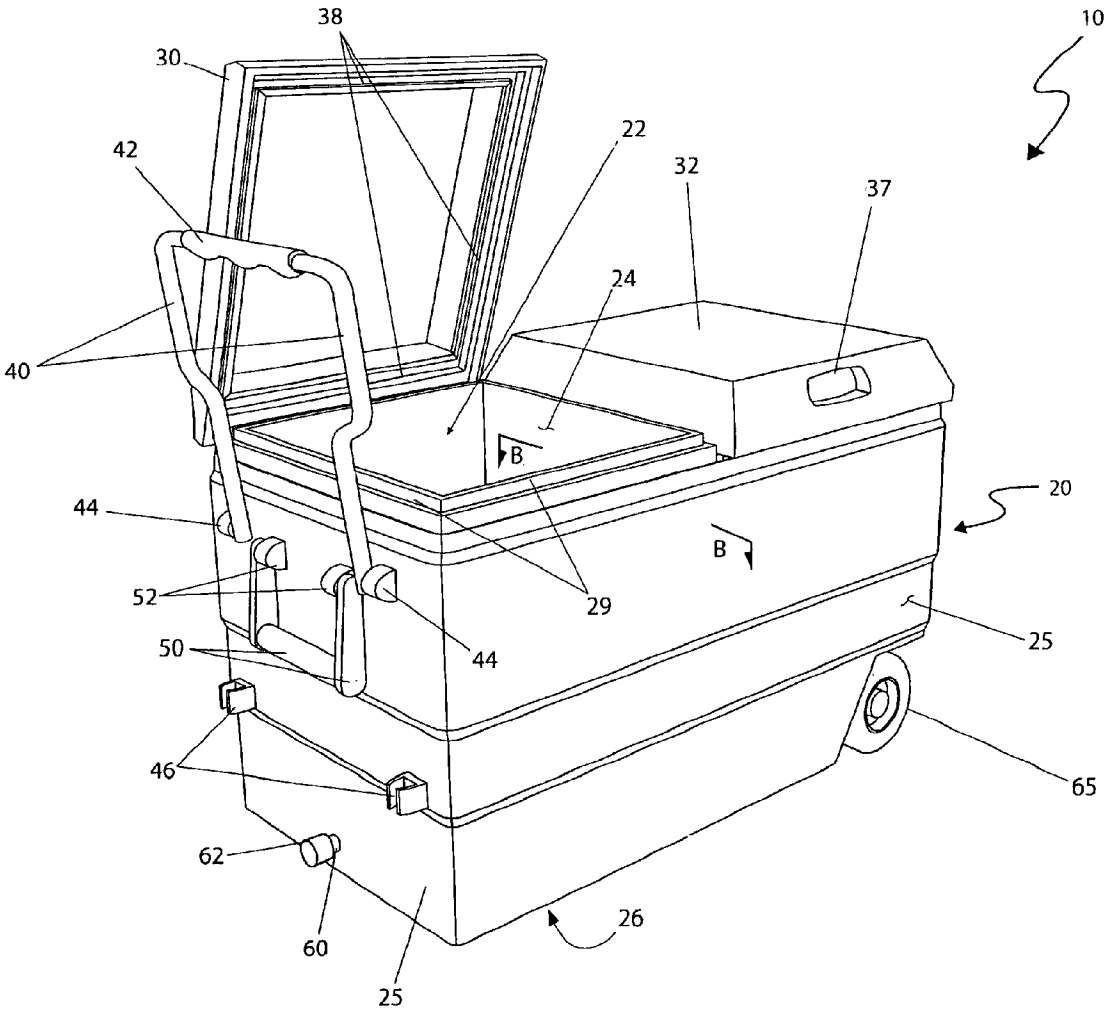
FIG. 2*a* is a left-hand perspective view of the cooler with multiple compartments 10 depicting deployment of a first handle portion 40, according to a preferred embodiment of the present invention.
Figure 2B:
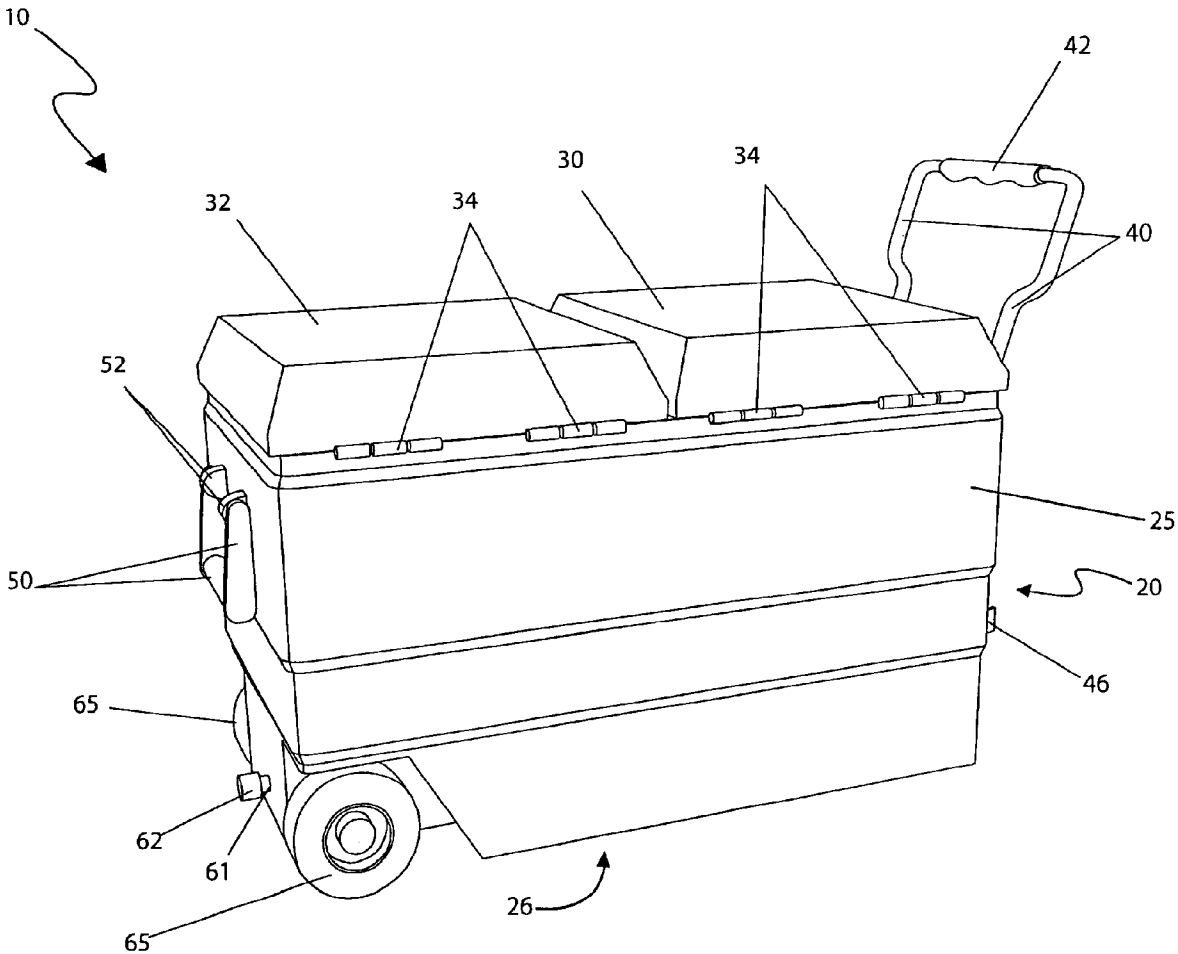
FIG. 2*b* is a rear perspective view of the cooler with multiple compartments 10 depicting deployment of a first handle portion 40, according to a preferred embodiment of the present invention.

Referring now to FIGS. 1, 2*a*, and 2*b*, right, left, and rear perspective views of the apparatus 10, according to the preferred embodiment of the present invention, is disclosed. The apparatus 10 comprises a cooler body 20, a forward compartment 22, a rear compartment 23, a forward lid 40, a rear lid 32, a pair of lid hand grips 37, a pair of drains 60, and a pair of wheels 65. The cooler body 20 comprises a hollow box structure having two (2) individual open-top cavities further comprising a body dividing wall 24, a body outer wall 25, and a body floor 26. The cooler body 20 is envisioned being a hollow plastic structure produced in a vacuum or blow-molding process. The cooler body 20 further comprises a forward compartment 22 and a rear compartment 23 being insulated and utilized for the storage of foodstuffs and/or drink items therewithin. The cooler body 20 is depicted here having approximate dimensions of three (3) feet long, two (2) feet wide, and two (2) feet tall; however, it is understood that the apparatus 10 may be provided in various smaller or larger sizes based upon a volume of an anticipated load to be contained therein, as well as a user's preference. The cooler body 20 comprises a plurality of hollow wall portions including the body dividing wall 24, a plurality of body outer walls 25, and the body floor 26. Said wall and floor portions 24, 25, 26 are filled therewith an insulation material 28 therewithin a hollow portion, thereby providing a thermal insulating means thereto internal contents thereof in a similar manner as other common commercially available coolers (see FIG. 4*b*). The thickness of said wall and floor portions 24, 25, 26 is envisioned to be approximately one (1) to two (2) inches; however, it is understood that a particular thickness may vary to obtain a desired insulation value for the apparatus 10.

The open-top portions of said compartments 22, 23 provide an attachment means thereto a forward lid 30 and a rear lid 32, respectively, both having a slightly larger perimeter edge region than the respective compartments 22, 23. Each lid 30, 32 comprises a lid hand grip 37 centered thereupon a side surface opposite a hinged edge portion and being adjacent thereto a side portion of the cooler body 20. The lid hand grips 37 comprise molded-in oval-shaped recessed features conforming thereto finger portions of a human hand and being integral thereto each lid 30, 32; however, it is understood that many other embodiments and/or designs of the lid hand grips 37 may be provided such as latches, pivoting handles, straps, or the like, without deviating from the basic concept and as such should not be interpreted as a limiting factor of the present invention 10. The forward compartment 22 and a rear compartment 23 comprise rectangular interior spaces providing dimensions being sufficient to accommodate food stuffs and non-perishable items of various sizes and forms providing containment, thermal insulation, and shielding therefrom contaminants such as, but not limited to, dust, dirt, grime, and other forms of contamination. The cooler body 20 comprises an integrally-molded vertical dividing wall 27 therebetween said forward 22 and rear 23 compartments, thereby providing thermal and fluid isolation thereto said compartments 22, 23, as well as eliminating cross-contamination therebetween. The cooler body 20, the compartments 22, 23, and the lids 30, 32 are envisioned to be provided in a variety of colors, textures, and patterns based upon a user's preference.

The cooler body 20 also provides rotating attachment thereto a pair of sturdy plastic wheels 65 being laterally spaced and rotatably secured along rearward underside corner portions of each side body outer wall 25 providing relative rotation to the cooler 20. The wheels 65 comprise large diameter solid or hollow units made using plastic or metal parts being capable of supporting and transporting an applied weight therefrom the apparatus 10 and contained items such, but not limited to: food, bait, caught fish, drinks, and the like, stored therewithin the compartments 22, 23. The wheels 65 comprise a single horizontal interconnecting axle member 67 affixed and supported therealong a bottom surface of the body floor 26 in a conventional manner (see FIG. 4*a*). Said wheels 65 are arranged in such a manner so as to be positioned slightly above a ground surface when the apparatus 10 is at a resting stationary state; however, upon lifting an opposing end portion of the cooler body 20 using a handle, said wheels 65 pivot downwardly to make contact therewith a floor or ground surface, thereby allowing easy relocation and transport of the apparatus 10 over small obstructions.

The apparatus 10 comprises a pair of hinges 34, a first handle 40, and a pair of second handles 50. Each lid 35, 36 provides an attachment means thereto the cooler body 20 via a pair of hinges 34 located along a side wall portion of the cooler body 20 allowing the lids 25, 26 to engage the dividing 24 and outer 25 wall portions of the cooler body 20 and being capable of pivotally lifting upwardly and lowering downwardly in an expected manner. Said hinges 34 preferably comprise integrally molded and rotatingly interlocking features; however, metal hinges may also be provided with equal benefit, being affixed thereto respective lids 35, 36 and side walls 25 using common fasteners such as rivets, screws, or the like, and as such should not be interpreted as a limiting factor of the apparatus 10. The lids 35, 36 and the cooler body 20 further comprise mating sealing surfaces which provide a sealing means thereto the compartments 35, 36 (see FIG. 4*a*).

A front wall portion of the cooler body 20 provides rotary attachment thereto a rotating first handle 40 which further comprises a first handle grip 42. The first handle 40 comprises a "U"-shaped round tubular appendage being ergonomically design for effective grasping and being approximately sixteen (16) inches long. The first handle 40 is utilized in conjunction therewith the wheels 65 to provide relative motion of the apparatus 10 from place-to-place. The first handle 40 may be angularly adjustably raised or lowered, with respect to the cooler body 20 via a pair of first handle pivots 44 which comprise molded-in horizontal axial features being integral thereto the first handle 40 and an upper forward surface of the cooler body 20. The first handle grip 42 is located along a perpendicular connecting portion of said first handle 40 providing expected features such as a high friction surface covering of rubber or plastic and recessed finger indentations shaped to accommodate an average person's hand for convenient and firm gripping during transportation of the apparatus 10.

The cooler body 20 further provides an attachment means thereto a pair of second handles 50 being affixed thereto front and rear body outer wall portions 25 of said cooler body 20 via respective second handle pivots 52. The pair of second handles 50 provide an optional carrying means thereto the apparatus 10 in lieu of utilizing the first handle 40 and wheels 65 as previously described. Said pair of second handles 50 each comprise a "U"-shaped appendage capable of pivotally lifting upwardly and lowering downwardly in an expected manner via integrally-molded axial second handle pivot member 52. The pair of second handles 50 are located so as to be aligned thereto each other therealong opposing front and rear body outer walls 25, thereby allowing a user, or users, to grasp both second handles 50 and lift the apparatus 10 vertically therefrom a ground or floor surface for carrying across rough terrain, up stairs, or the like.

Figure 3:
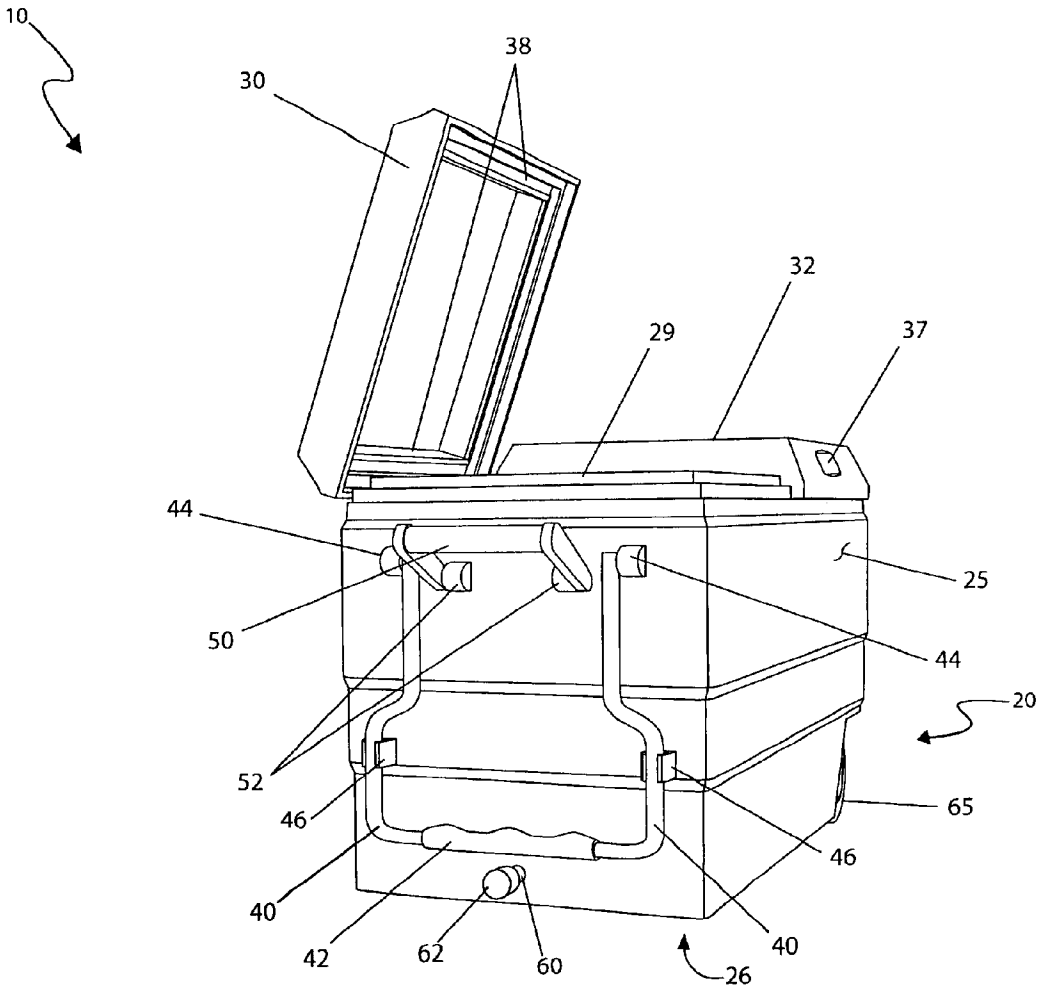
FIG. 3 is a left-side perspective view of the cooler with multiple compartments 10 depicting a stored state of a first handle portion 40, according to a preferred embodiment of the present invention.

FIG. 3 is a left end view of the apparatus 10 depicting a stored state of the first handle portion 40, according to a preferred embodiment of the present invention. The first handle portion 40 is to be retained therein a secured storage state via a pair of "C"-shaped first handle clip fixtures 46 depicted here being molded thereinto the front surface of the cooler body 20; however, it is understood that separate plastic or metal fixtures 46 may be affixed thereto said cooler body 20 using common fasteners with equal benefit and as such should not be interpreted as a limiting factor of the apparatus 10. Said first handle clip fixtures 46 allow snapping attachment of said first handle 40 thereat a downward orientation, thereby providing secure attachment when not being utilized to transport the apparatus 10.

Figure 4A:
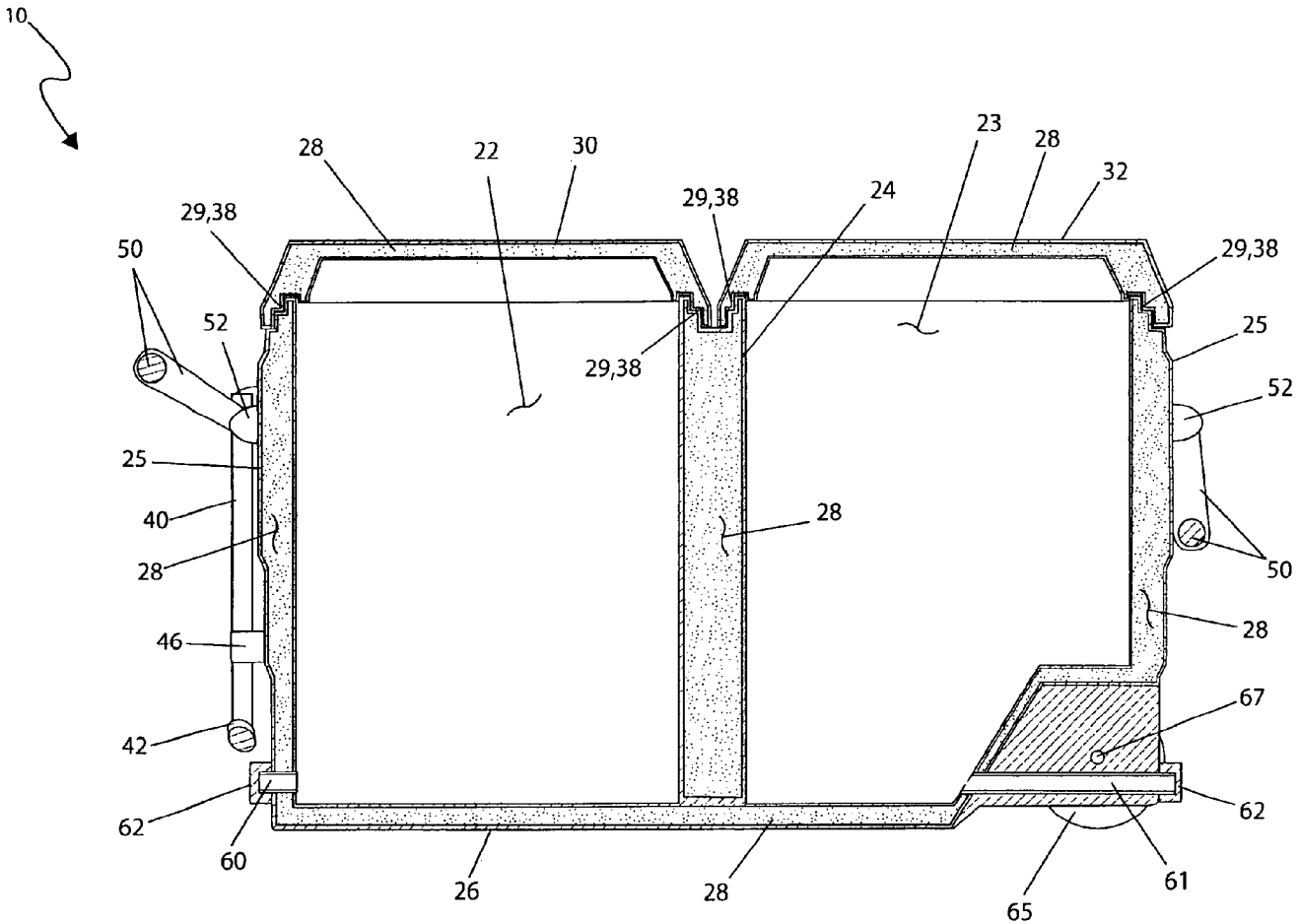
FIG. 4*a* is a section view taken along section line A-A (see FIG. 1) of the cooler with multiple compartments 10, according to a preferred embodiment of the present invention; and, FIG. 4*b* is a close-up section view of a first sealing surface 29 and a second sealing surface 38 taken along section line B-B (see FIG. 2), according to a preferred embodiment of the present invention.

FIG. 4*a* is a section view taken along section line A-A (see FIG. 1) of the apparatus 10, according to a preferred embodiment of the present invention. The apparatus 10 comprises a pair of drains 60 providing convenient removal of fluids therefrom each compartment 20, 22. Each drain 60 is installed therealong a inner floor portion of respective forward and rear body outer wall portions 25 of the cooler body 20, being in fluid communication therewith, thereby providing a drainage means thereto fluids such as condensation, accidental spillage, or the like. The drains 60 are depicted here comprising a cylindrical female threaded cap 62; however, any number of drain designs may be provided including those with button activated valves, half-turn valves, friction-fit stoppers, or the like, and as such should not be considered a limiting factor of the invention 10.

Figure 4B:
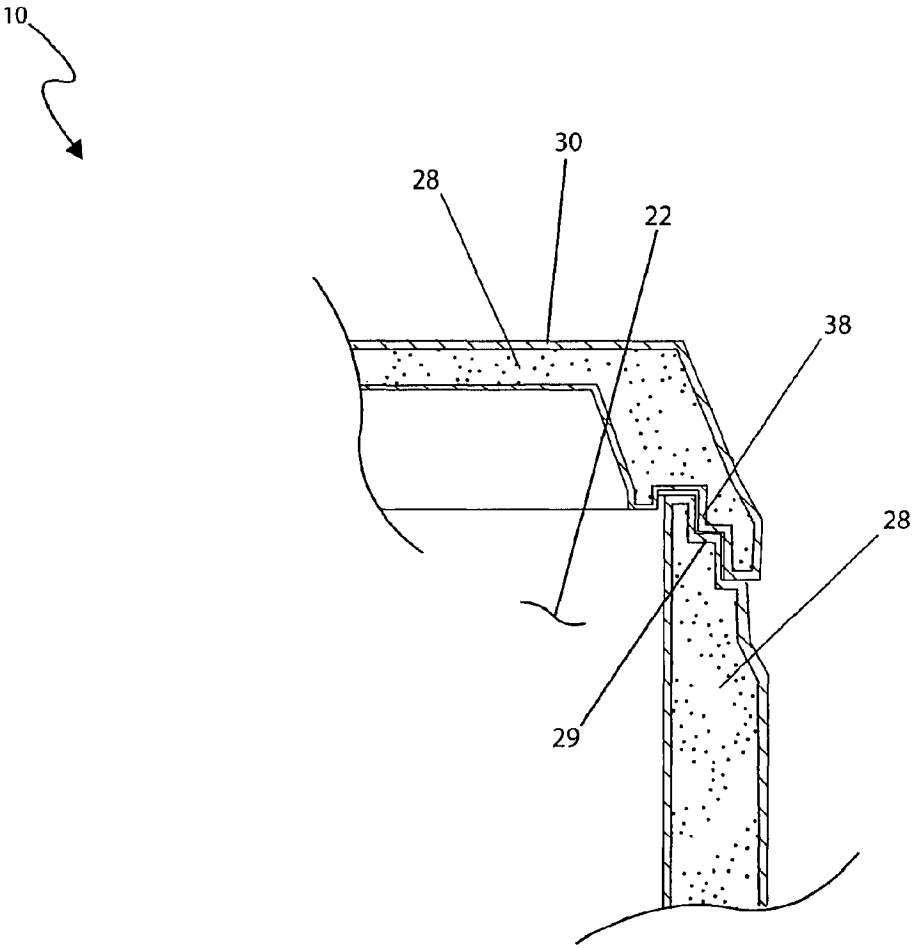

FIG. 4*b* is a close-up section view of a first sealing surface 29 and a second sealing surface 38 taken along section line B-B (see FIG. 2), according to a preferred embodiment of the present invention, is disclosed. The first 29 and second 38 sealing surfaces comprise multi-faceted "L"-shaped parallel contact surfaces being integrally-molded thereinto respective edges of the body dividing wall 24, body outer walls 25, and lids 30, 32, thereby forming a continuous thermal and fluid perimeter seal therearound being approximately one (1) inch wide. Each compartment 22, 23 comprises a first sealing surface 29 along each upper perimeter region and each lid 30, 32 further comprises a geometrically corresponding second sealing surface 38. The first 29 and second 38 sealing surfaces form a sealing fit thereto each other, thereby providing an effective thermal seal to each of the compartments 22, 23. However, it is understood that other sealing features having various profile geometry may be incorporated therein said compartments 22, 23 and lids 30, 32 which provide an equivalent sealing means thereof and as such should not be interpreted as a limiting factor of the apparatus 10.

The compartments 22, 23 and lids 30, 32 further comprise hollow portions filled therewith insulation 28 envisioned to be a common insulating material such as, but not limited to: solid or granulated polystyrene, or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 and 2.

The method of utilizing the apparatus 10 may be achieved by performing the following steps: opening the forward lid portion 30 of the apparatus 10 using the hinges 34 and the lid hand grip 37; placing food stuffs, drink containers, fishing bait, and/or any other substances requiring temperature tempering therewithin the insulated forward compartment 22; opening the rear lid portion 32 of the apparatus 10 in like manner; placing additional food stuffs, fluid, or other substances therewithin the rear compartment 23 for separate storage and/or differing thermal/temperature conditioning requirements; closing the lids 30, 32; unfastening the first handle 40 therefrom the first handle clip fixtures 46; lifting and rotating the first handle 40 upwardly; grasping said first handle 40 so as to lift a forward portion of the cooler body 20 off a ground or floor surface, thereby transferring weight applied thereby the apparatus 10 and contents thereto the wheels 65; and, pulling said first handle 40 in conjunction therewith the wheels 65 to easily transport the apparatus 10 to a desired site. The apparatus 10 may also be transported by grasping both of the second handles 50 and lifting the apparatus 10 vertically off a ground or floor surface for carrying across rough terrain, up stairs, or the like; opening the lids 35, 36 to obtain the food, fluid, or other substances from therewithin the compartments 25, 26 as needed; closing said lids 35, 36 to maintain an internal temperature therewithin; and, benefiting from effective thermal and fluid isolation of items stored therewithin the two (2) compartments 25, 26 and avoiding possible cross-contamination between perishable and/or non-perishable items stored therewithin while using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A cooler, comprising a cooler body, comprising two (2) separate and thermally independent storage compartments divided thereby an interior divider wall extending completely between side portions of said cooler body thereby providing a sealing means of said independent storage compartments;

wherein said cooler body further comprises a hollow box structure further comprising:

a forward compartment, comprising an open-top cavity with a forward interior with a closure means;

a rearward compartment, comprising an open-top cavity with a rearward interior with said closure means;

said interior divider wall separating said forward compartment from said rearward compartment;

a plurality of cooler body outer walls, thereby encompassing said forward compartment and said rearward compartment; and, a cooler body floor;

wherein said closure means provides access to said forward interior and said rearward interior; and, wherein said closure means provides a securing means for contents in said forward interior and said rearward interior;

wherein said closure means further comprises:

a lid comprising a first end and a second end;

a grip means on an outer surface of said first end of said lid;

an attachment means hingedly securing said second end of said lid to an upper perimeter portion of a respective forward or rearward compartment;

a first sealing means comprising a multi-faceted "L"-shaped parallel contact surface integrally-molded into respective edges of said interior divider wall and said plurality of cooler body outer walls, and, a second sealing surface comprising a corresponding multi-faceted "L"-shaped parallel contact surface integrally-molded into said lid;

wherein said first sealing surface and said second sealing surface interlock, thereby forming a continuous thermal and fluid perimeter seal between said upper perimeter portion and said lid;

wherein said cooler provides a thermal insulating means for transportation and storage of contents therein; and, wherein said interior divider wall prevents cross-contamination therebetween contents within said independent storage compartments.

2. The cooler of claim 1, wherein said interior divider wall, and said plurality of cooler body outer walls and said cooler body floor each comprises a hollow interior portion, thereby defining an interstitial space.

3. The cooler of claim 2, wherein said interstitial space is filled therewith insulation, thereby providing said thermal insulating means.

4. The cooler of claim 3, wherein said insulation further comprises solid or granulated polystyrene.

5. The cooler of claim 4, wherein said grip means further comprises a molded-in oval-shaped recessed feature conforming thereto finger portions of a human hand and being integral thereto said lid.

6. The cooler of claim 1, further comprising a pair of sturdy wheels rotatingly attached thereto and laterally spaced along rearward underside corner portions of each side cooler body outer wall, further comprising a single horizontal interconnecting axle member affixed and supported therealong a bottom surface of said cooler body floor and positioned slightly above a ground surface when said cooler is at a resting stationary state.

7. The cooler of claim 1, further comprising:

a first handle comprising a first handle grip;

a pair of first handle pivots integral thereto said first handle rotatingly attaching said first handle thereto an upper portion of a cooler body front wall; and, a pair of first handle clip fixtures comprising an integral portion thereof an intermediate portion thereof said cooler body front wall;

wherein said first handle is angularly adjusted therebetween a raised position and a stored position; and, wherein said first handle is retained therein said pair of first handle clip fixtures when said first handle is in said stored position.

8. The cooler of claim 7, further comprising:

a front second handle;

a pair of front second handle pivots integral thereto said front second handle pivotally attaching said front second handle thereto said upper portion of a cooler body front wall adjacent thereto said pair of first handle pivots;

a rear second handle; and, a pair of rear second handle pivots integral thereto said rear second handle pivotally attaching said rear second handle thereto an upper portion of a cooler body rear wall;

wherein said front second handle and said rear second handle are positioned so as to be horizontally aligned.

9. The cooler of claim 1, further comprising:

a first drain located therein a bottom location thereof said cooler body front wall and secured therewith a first drain securing means and in fluid communication therewith said first interior; and, a second drain located therein a bottom location thereof said cooler body rear wall and secured therewith a second drain securing means and in fluid communication therewith said second interior.

10. A cooler, further comprising:

a cooler body comprising a hollow box structure further comprising:

a forward compartment, comprising an open-top cavity with a forward interior with a closure means;

a rearward compartment, comprising an open-top cavity with a rearward interior with a closure means;

an interior divider wall separating said forward compartment therefrom said rearward compartment;

a plurality of cooler body outer walls, thereby encompassing said forward compartment and said rearward compartment; and, a cooler body floor;

a pair of wheels rotatingly attached thereto and laterally spaced along rearward underside corner portions of each side cooler body outer wall, further comprising a single horizontal interconnecting axle member affixed and supported therealong a bottom surface of said cooler body floor and positioned slightly above a ground surface when said cooler is at a resting stationary state;

a first handle comprising a first handle grip, a pair of first handle pivots integral thereto said first handle rotatingly attaching said first handle thereto an upper portion of a cooler body front wall, and a pair of first handle clip fixtures comprising an integral portion thereof an intermediate portion thereof said cooler body front wall;

a front second handle comprising a pair of front second handle pivots integral thereto said front second handle pivotally attaching said front second handle thereto said upper portion of a cooler body front wall adjacent thereto said pair of first handle pivots;

a rear second handle, comprising a pair of rear second handle pivots integral thereto said rear second handle pivotally attaching said rear second handle thereto an upper portion of a cooler body rear wall;

a first drain located therein a bottom location thereof said cooler body front wall and secured therewith a first drain securing means and in fluid communication therewith said first interior; and, a second drain located therein a bottom location thereof said cooler body rear wall and secured therewith a second drain securing means and in fluid communication therewith said second interior;

wherein said closure means further comprises:

a first sealing means comprising a multi-faceted "L"-shaped parallel contact surface integrally-molded into respective edges of said interior divider wall, said plurality of cooler body outer walls, and, a second sealing surface comprising a corresponding multi-faceted "L"-shaped parallel contact surface integrally-molded into said lid;

wherein said first sealing surface and said second sealing surface interlock, thereby forming a continuous thermal and fluid perimeter seal between said upper perimeter portion and said lid;

wherein said closure means provides access thereto said forward interior and said rearward interior;

wherein said closure means provides a securing means therefor contents therein said forward interior and said rearward interior;

wherein said cooler provides a thermal insulating means for transportation and storage of contents therein;

wherein said interior divider wall prevents cross-contamination therebetween contents within said independent storage compartments;

wherein said first handle is angularly adjusted therebetween a raised position and a stored position;

wherein said first handle is retained therein said pair of first handle clip fixtures when said first handle is in said stored position;

wherein said first handle acts in concert therewith said pair of wheels to provide a first transportation means when said first handle is in said raised position;

wherein said front second handle and said rear second handle are positioned so as to be horizontally aligned; and, wherein said front second handle acts in concert therewith said rear second handle to provide a second transportation means.

11. The cooler of claim 10, wherein said interior divider wall, and said plurality of cooler body outer walls and said cooler body floor each comprises a hollow interior portion, thereby defining an interstitial space.

12. The cooler of claim 11, wherein said interstitial space is filled therewith insulation, thereby providing said thermal insulating means.

13. The cooler of claim 12, wherein said insulation further comprises solid or granulated polystyrene.

14. The cooler of claim 13, wherein said closure means further comprises:

a lid, comprising a first end and a second end;

a grip means thereon an outer surface thereof said first end thereof said lid; and, an attachment means hingedly securing said second end thereof said lid thereto an upper perimeter portion thereof said respective forward or rearward compartment.

15. The cooler of claim 14, wherein said grip means further comprises a molded-in oval-shaped recessed feature conforming thereto finger portions of a human hand and being integral thereto said lid.

16. The cooler of claim 10, further comprising a pair of sturdy wheels rotatingly attached thereto and laterally spaced along rearward underside corner portions of each side cooler body outer wall, further comprising a single horizontal interconnecting axle member affixed and supported therealong a bottom surface of said cooler body floor and positioned slightly above a ground surface when said cooler is at a resting stationary state.

* * * * *